US006769515B2

(12) United States Patent
Hillebrecht et al.

(10) Patent No.: US 6,769,515 B2
(45) Date of Patent: Aug. 3, 2004

(54) MULTI-FOLD COLLAPSIBLE LADDER

(75) Inventors: Luke Hillebrecht, Kent, OH (US); Paul K. Meeker, Hiram, OH (US); William R. Gibson, Kent, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/346,628

(22) Filed: Jan. 17, 2003

(65) Prior Publication Data

US 2004/0026173 A1 Feb. 12, 2004

Related U.S. Application Data

(60) Provisional application No. 60/402,588, filed on Aug. 9, 2002.

(51) Int. Cl.[7] ..... E06C 1/00
(52) U.S. Cl. ..... 182/159
(58) Field of Search ..... 182/159, 160, 182/96, 165, 106

(56) References Cited

U.S. PATENT DOCUMENTS 2,088,878 A * 8/1937 Stogner ..... 182/162
4,106,590 A * 8/1978 Tarran ..... 182/20
5,685,394 A * 11/1997 Simson ..... 182/159

OTHER PUBLICATIONS

"Fold–Away Four–Foot Ladder" Advertisement Literature (May 28, 2002 two pages) (website http://www.hammacher-er.com/publish/60156.asp).
Prior Arts Photos 1–6 of Hammacher Schlemmer Item 60156.

* cited by examiner

*Primary Examiner*—Alvin Chin-Shue
(74) *Attorney, Agent, or Firm*—Barnes & Thornburg

(57) ABSTRACT

A ladder includes a frame and a plurality of folding steps. The ladder includes a step mover coupled to the steps to allow pivotable movement of the step sections relative to the left and right legs as the ladder is moved between opened and closed positions.

17 Claims, 6 Drawing Sheets

MULTI-FOLD COLLAPSIBLE LADDER

This application claims priority under 35 U.S.C. § 119(e) to U.S. Provisional Application Serial No. 60/402,588, filed Aug. 9, 2002, which is expressly incorporated by reference herein.

BACKGROUND AND SUMMARY

The present disclosure relates to a ladder, and particularly to a collapsible ladder. More particularly, the present disclosure relates to a collapsible ladder including steps mounted on a frame for movement relative to the frame.

Ladders have a frame and one or more steps that people use for elevation when reaching for objects, painting walls, or any everyday task where extra elevation would be helpful. Ladders are often foldable for ease of storage when the ladder is not being used.

According to the present disclosure, a collapsible ladder includes left and right legs and several foldable steps extending between the left and right legs. Each step includes a left step section pivotably coupled to the left leg and a right step section pivotably coupled to the right leg. In an opened position of the ladder, the left and right legs are arranged to lie in non-parallel relation to one another and the left and right step sections cooperating to form each step are "aligned" to lie in end-to-end relation to one another. Higher steps are shorter in length while lower steps are longer in length. In a closed position of the ladder, the left and right legs are arranged to lie in parallel relation to one another and the left and right step sections cooperating to form each step are "folded" to lie in side-by-side relation to one another.

The ladder further includes a step mover for moving the left and right sections of each step between the aligned, end-to-end position and the folded, side-by-side position during movement of the left and right legs from the closed position to the opened position. Thus, the steps are equidistantly spaced apart from one another when the left and right legs are arranged to lie in non-parallel (splayed) relation in the opened position. This equidistant spacing is accomplished even though the higher steps are shorter in length and the lower steps are longer in length owing to he non-parallel, splayed orientation of the right and left legs in the opened position of the ladder. When opened, the spacing between the left and right legs is wider at the bottom and narrower at the top.

In an illustrative embodiment, a collapsible auxiliary frame is pivotably coupled to the left and right legs. A linkage is coupled to the collapsible auxiliary frame and to the left and right legs to support the left and right legs (and the steps mounted thereto) in a predetermined inclined position upon lateral spreading movement of the left and right legs relative to one another to the opened position and upon pivoting movement of the left and right legs relative to the auxiliary frame.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
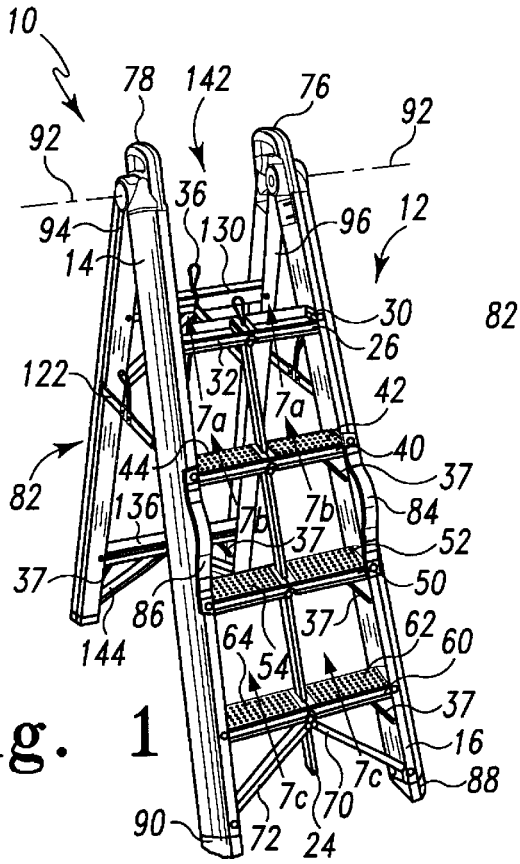
FIG. 1 is a perspective view of a multi-fold collapsible ladder in accordance with the present disclosure, showing an inclined frame with a left and a right leg in an opened position and an auxiliary frame in a predetermined inclined position.
Figure 3:
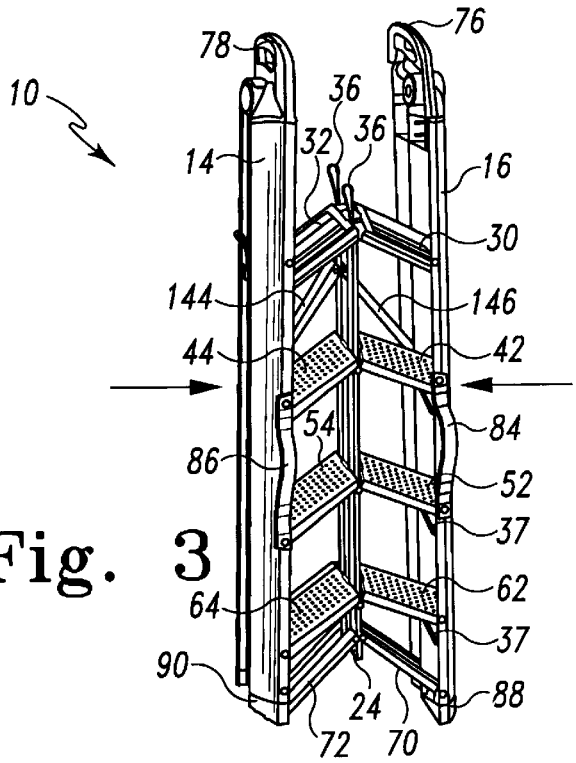
FIG. 3 is a perspective view similar to FIG. 2 showing the ladder in motion to a closed position.
Figure 4:
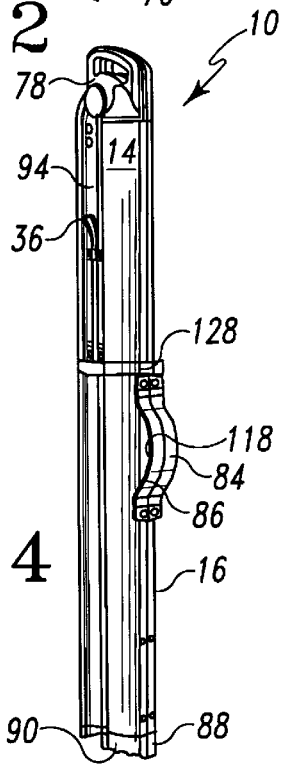
FIG. 4 is a perspective view of the ladder of FIGS. 1–3 in a closed position secured with a retention strap.

A collapsible ladder 10 is shown in an opened position in FIG. 1 and in a closed position in FIG. 4. Ladder 10 includes a frame 12 having a left leg 14, a right leg 16, a step guide 26, a step mover 18, and a plurality of bi-folding steps 40, 50, and 60 arranged to lie between the left and right legs 14 and 16. An auxiliary frame 82 is coupled for pivotable movement to frame 12. Auxiliary frame 82 can be pivoted from an opened position shown in FIG. 1 about a pivot axis 92 toward frame 12 to assume a partially closed position as shown in FIG. 3. In a preferred embodiment, an individual is able to fold ladder 10 easily to a closed position as shown in FIG. 4 because of the bi-folding arrangement of guide 26 and steps 40, 50, and 60, which allows legs 14 and 16 to be folded relative to each other, thus reducing the overall profile of the closed ladder 10 for ease of storage.

Referring now to FIG. 1, frame 12 includes left leg 14 having a foot 90, and a grip handle 78 formed to include a receiver for coupling frame 82 to leg 14. Likewise, ladder 10 includes right leg 16 having a foot 88, and a grip handle 76 formed to include a receiver for coupling frame 82 to leg 14.

Figure 6:
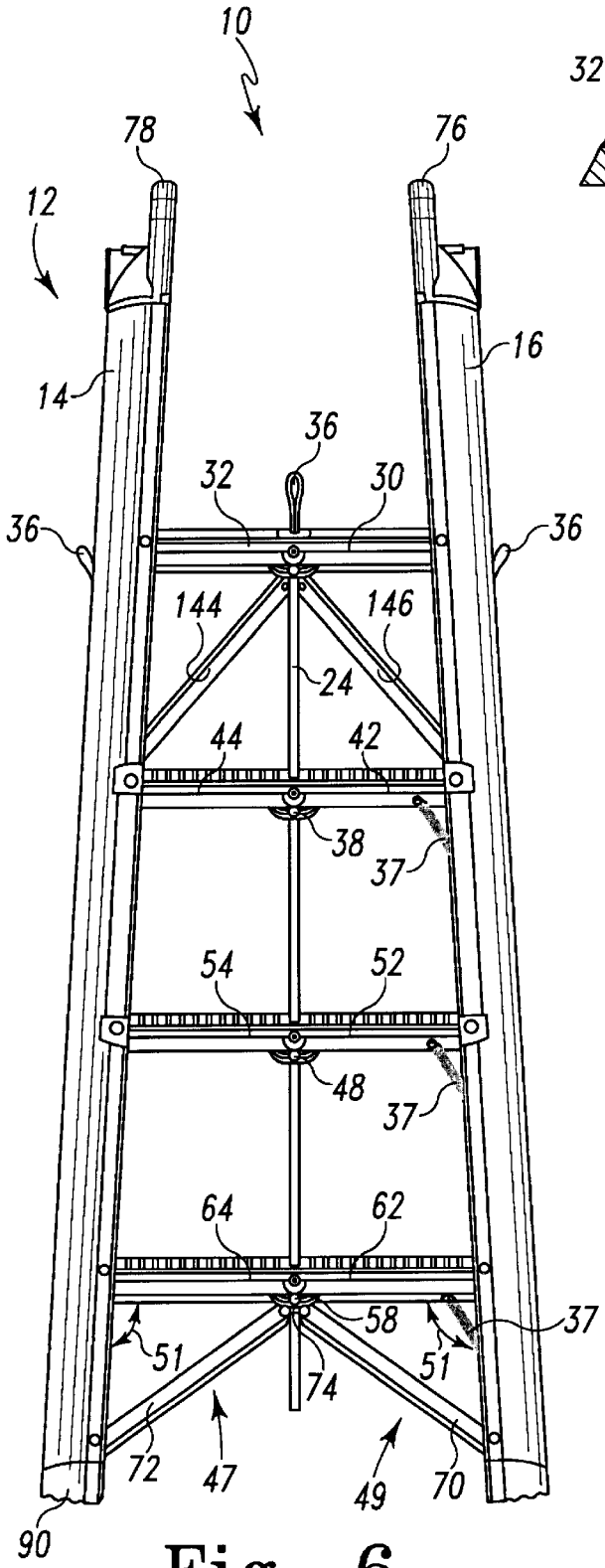
FIG. 6 is a front elevation view of the ladder of FIG. 1 in the opened position, showing the left and right legs arranged to lie in a splayed, non-parallel relation to one another, and showing the location of the rod relative to each step and the slider hinge associated therewith.

When ladder 10 is in the opened position, as shown best in FIGS. 1 and 6, left leg 14 is arranged to lie in a splayed, non-parallel relation to right leg 16. Guide 26 includes a left guide section 32 coupled for pivotable movement to leg 14, and a right guide section 30 coupled for pivotable movement to leg 16. In the opened position, left guide section 32 and right guide section 30 are arranged to lie in end-to-end relation to one another. An anchor hinge 22 is coupled to left guide section 32 and right guide section 30 to support the right and left guide sections 30, 32 for relative movement to one another about a guide pivot axis 34.

Step mover 18 includes a rod 24 and a pull handle 36. Rod 24 is coupled to anchor hinge 22 and configured to assist guide 26 as it is moved from the aligned position shown in FIG. 1 to the folded position shown in FIG. 4. Step mover 18 provides means for moving rod 24 in an upward direction relative to legs 14, 16 so that, for example, the companion pair of step sections 42, 44 move to the folded position and legs 14, 16 to the closed position.

Figure 5:
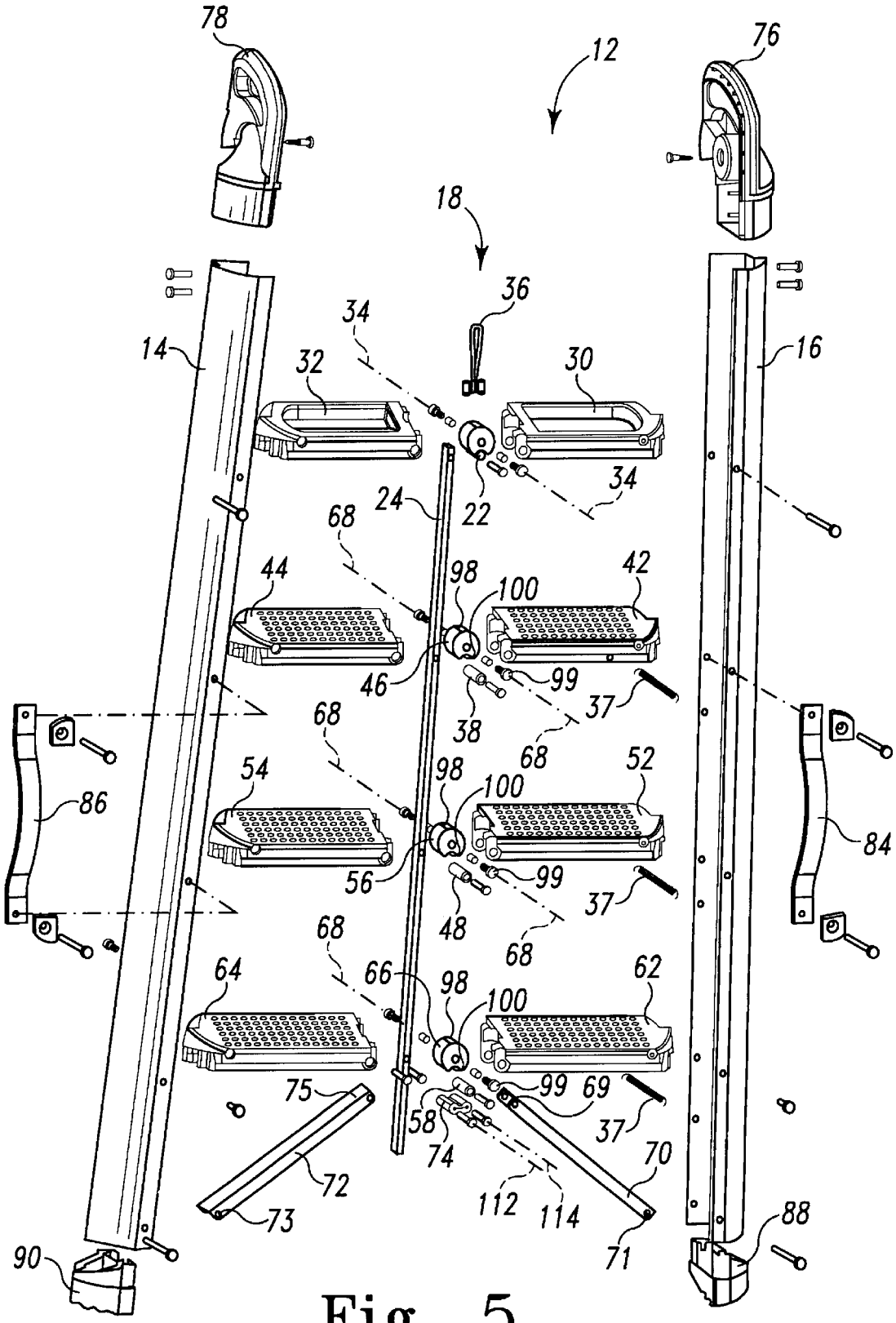
FIG. 5 is an exploded perspective assembly view of the ladder of FIGS. 1–4 showing the left and right legs of the step frame, a guide (that appears to be a "top step"), and three steps located below the guide and between the left and right legs, an anchor hinge associated with the mid-point of the guide, a slider hinge associated with the mid-point of each step, and a rod arranged to extend through the slider hinge at the mid-point of each step and to allow upward and downward movement of the slider hinge relative to the steps and relative to cantilevered step-support posts mounted on the rod.

As best shown in FIG. 5, a first of the steps 40 includes a left step section 44 coupled for pivotable movement to leg 14 and a right step section 42 coupled for pivotable movement to leg 16. Since legs 14, 16 lie in non-parallel relation when ladder 10 is in the opened position, step 40 is slightly wider than guide 26 above it. A lower end of right step section 42 is also coupled to leg 16 with a spring 37. Spring 37 provides assist means for ease of opening ladder 10 so that step section 42 is retained in a horizontal attitude when ladder 10 is in the opened position.

A first of the slider hinges 46 includes a slide member 45. Hinge 46 is further formed to include a slot 98, a fastener 99, and a concave edge 100 which defines a downwardly opening notch 102. Hinge 46 is coupled to left step section 44 and right step section 42 and configured to support step sections 42, 44 for relative movement to one another. When step sections 42, 44 are in an aligned position in end-to-end relation, hinge 46 provides support means for keeping sections 42,44 from collapsing downward at their center when a user stands on step 40.

Figure 7A:
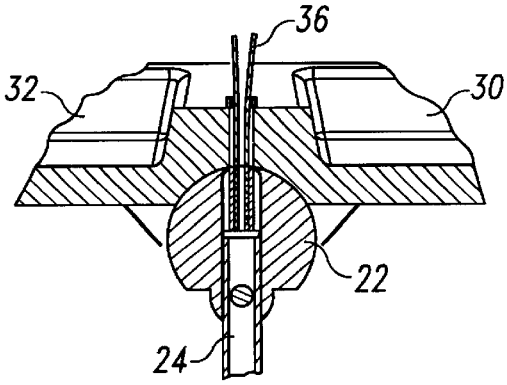
FIG. 7*a* is a sectional view of the anchor hinge and guide, with portions broken away, taken along line 7*a*–7*a* of FIG. 1 showing attachment of the rod to the anchor hinge further coupled to a left and a right guide section.
Figure 7B:
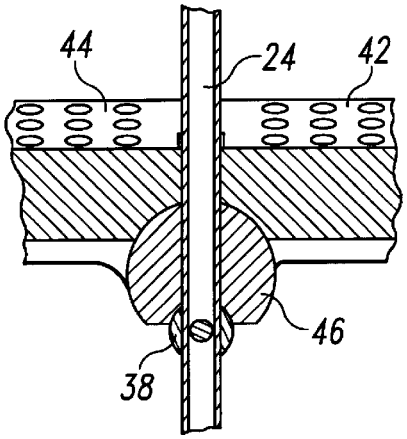
FIG. 7*b* is a sectional view, with portions broken away, taken along line 7*b*–7*b* of FIG. 1 showing passage of the vertical rod through the slider hinge coupled to a first step right section and a first step left section.
Figure 7C:
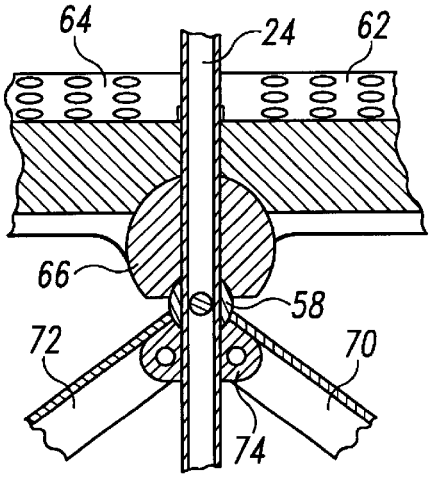
FIG. 7*c* is a sectional view, with portions broken away, showing the location of a left and a right diagonal brace relative to the post coupled to the rod and mounted to slide relative to the rod taken along line 7*c*–7*c* of FIG. 1.

A first post 38 is coupled to rod 24 in a cantilevered arrangement. First post 38 is configured to extend into the downwardly opening notch 102 and contact the concave edge 100 of hinge 46 upon movement of left and right legs 14, 16 to the opened position as shown best in FIG. 7*b*. Post 38 functions to keep step 40 from collapsing at its center when ladder 10 is in the opened position, and acts to begin sliding movement of hinge 46 when step mover 18 is operated in moving ladder 10 to the closed position.

As illustrated in FIG. 5, a second of the steps 50 includes a left step section 54 coupled for pivotable movement to leg 14 and a right step section 52 coupled for pivotable movement to leg 16. Right step section 52 is additionally coupled to leg 16 with spring 37. Spring 37 is configured in a similar manner and performs the same function with step section 52 as it does with step section 42. Since legs 14, 16 lie in non-parallel relation when ladder 10 is in the opened position, step 50 is slightly wider than the step 40 above it. Second step 50 is similar to, and operates in the same manner as step 40 located above it.

A second of the slider hinges 56 is associated with step 50. Hinge 56 is similar to and operates in the same manner as hinge 46 associated with step 40 as shown best in FIG. 5.

Referring now to FIG. 6, a second post 48 is associated with second step 50 and is coupled to rod 24 in a cantilevered arrangement similar to first post 38. Second post 48 performs the same function as post 38.

A third of the steps 60 includes a left step section 64 coupled for pivotable movement to leg 14 and a right step section 62 coupled for pivotable movement to leg 16 as shown, for example, in FIG. 5. Right step section 62 is additionally coupled to leg 16 with spring 37. Spring 37 is configured in a similar manner and performs the same function with step section 62 as it does with step sections 42 and 52. Since legs 14, 16 lie in non-parallel relation when ladder 10 is in the opened position, step 60 is slightly wider than the step 50 above it. Step 60 is similar to and operates in the same manner as steps 40 and 50 above it.

A third of the slider hinges 66 and a third post 58 are associated with step 60. As shown in FIG. 5, slider hinge 66 functions in the same manner as slider hinges 46 and 56. Post 58 is coupled to rod 24 in a cantilevered arrangement in the same manner as posts 38,48 and performs the same function.

As shown in FIG. 5, a rod support 120 is arranged to lie below third step 60 and configured to provide support for rod 24 when ladder 10 is in the opened position. Rod support 120 includes a left diagonal brace 72, a right diagonal brace 70, and a brace hinge 74 coupled to a portion of rod 24. Brace hinge 74 further includes a brace member 104 formed to include a brace member slot 106, a left fastener 108, and a right fastener 110.

A lower end 73 of left diagonal brace 72 is coupled to left leg 14 for pivotable movement. An upper end 75 of left diagonal brace 72 is coupled to brace hinge 74 with left fastener 108 to establish a left pivot axis 112. A lower end 71 of right diagonal brace 70 is coupled to right leg 16 for pivotable movement. An upper end 69 of right diagonal brace 70 is coupled to brace hinge 74 with right fastener 110 to establish a right pivot axis 114, as shown in FIGS. 1–5. Right and left diagonal braces 70, 72 further cooperate to define an obtuse included angle 51 when legs 14, 16 are in the opened position.

Figure 2:
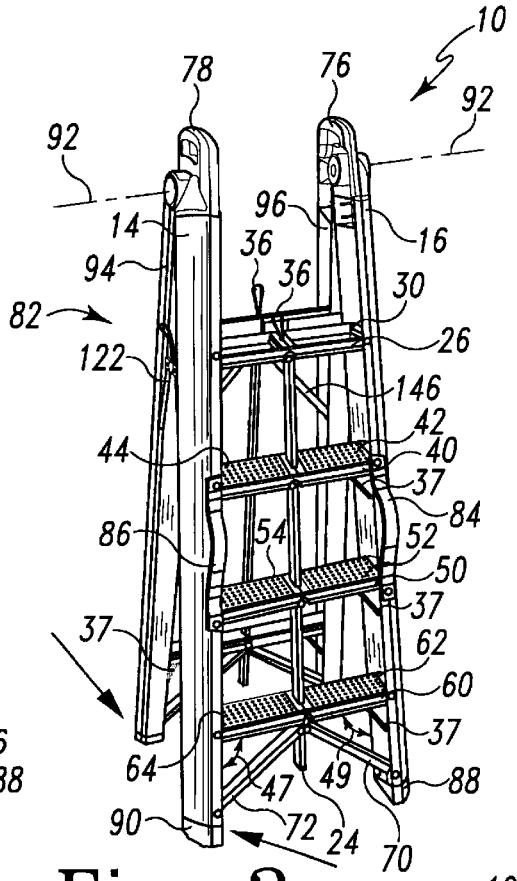
FIG. 2 is a perspective view of the ladder similar to FIG. 1 showing pivoting movement of the left and right legs toward the auxiliary frame about a pivot axis established at a junction between the left and right legs and the auxiliary frame.

As shown best in FIGS. 2 and 6, left diagonal brace 72 cooperates with step portion 64 and a portion of left leg 14 to form obtuse triangle 47. When a user stands on any step 40, 50, or 60, the downward force transmitted through rod 24 acts to stabilize triangle 47. Likewise, right diagonal brace 70 cooperates with step portion 62 and a portion of right leg 16 to form obtuse triangle 49. When a user stands on any step 40, 50, or 60, the downward force is transmitted through rod 24 to stabilize triangle 49. The downward force provides means for keeping triangles 47, 49 intact creating a stabilizing geometry in order to attenuate ladder racking.

As shown in FIG. 5, rod 24 is configured so that first post 38, second post 48, and third post 58 lie in an equidistantly spaced relationship. Thus, when ladder 10 is in the opened position, guide 26, first step 40, second step 50, and third step 60 are all an equal distance apart between the legs 14,16.

Figure 8:
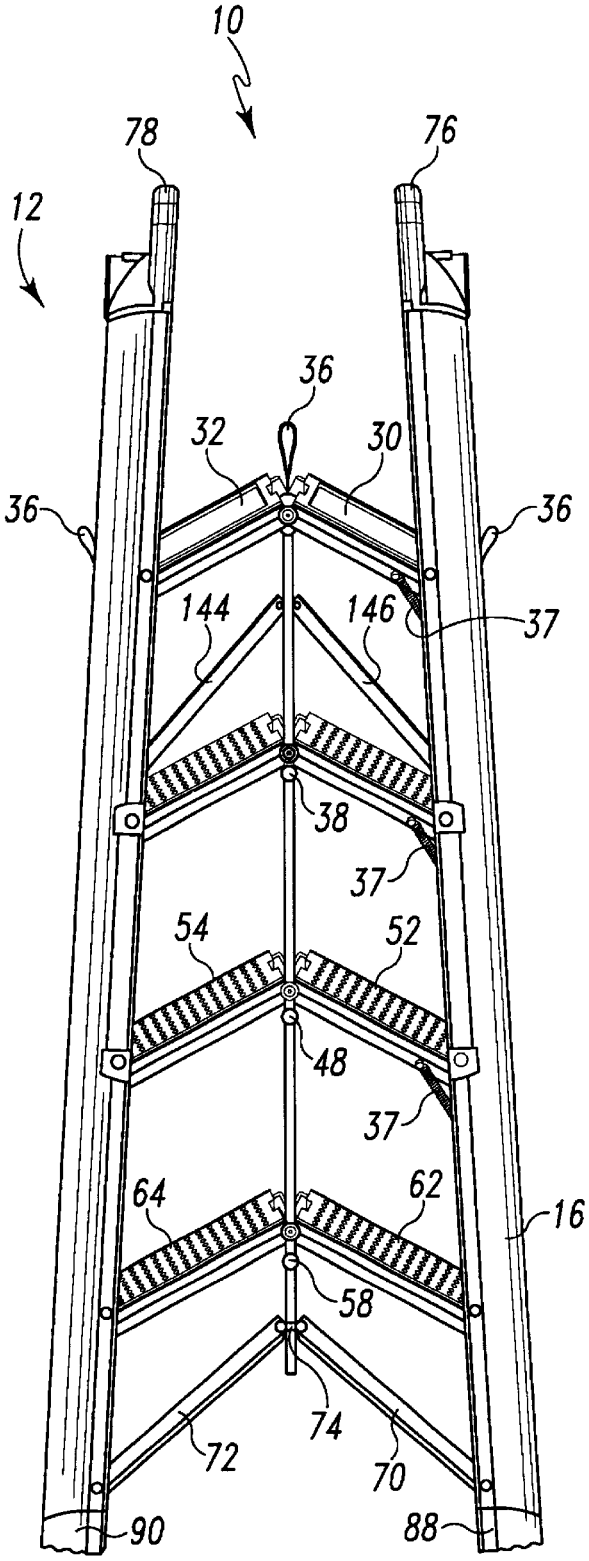
FIG. 8 is a front elevation view similar to FIG. 6, showing the movement of the ladder to the closed position.
Figure 9:
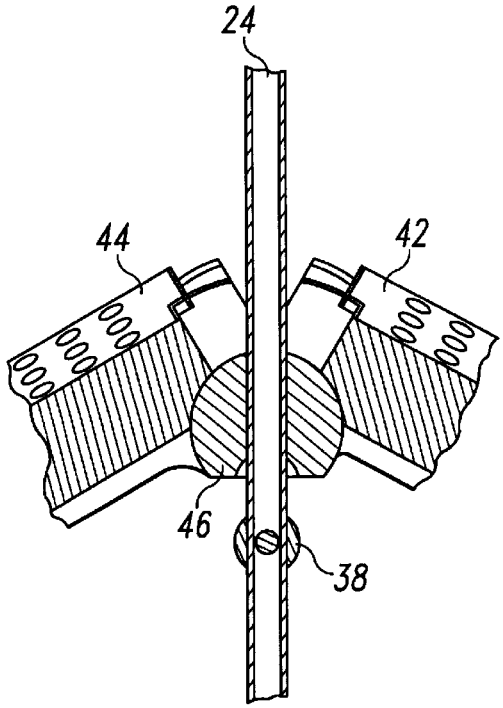
FIG. 9 is a sectional view, with portions broken away, of the slider hinge taken along line 9—9 of FIG. 3 showing movement of the slider hinge and the step sections coupled thereto in an upward direction away from the companion post coupled to the rod.
Figure 10:
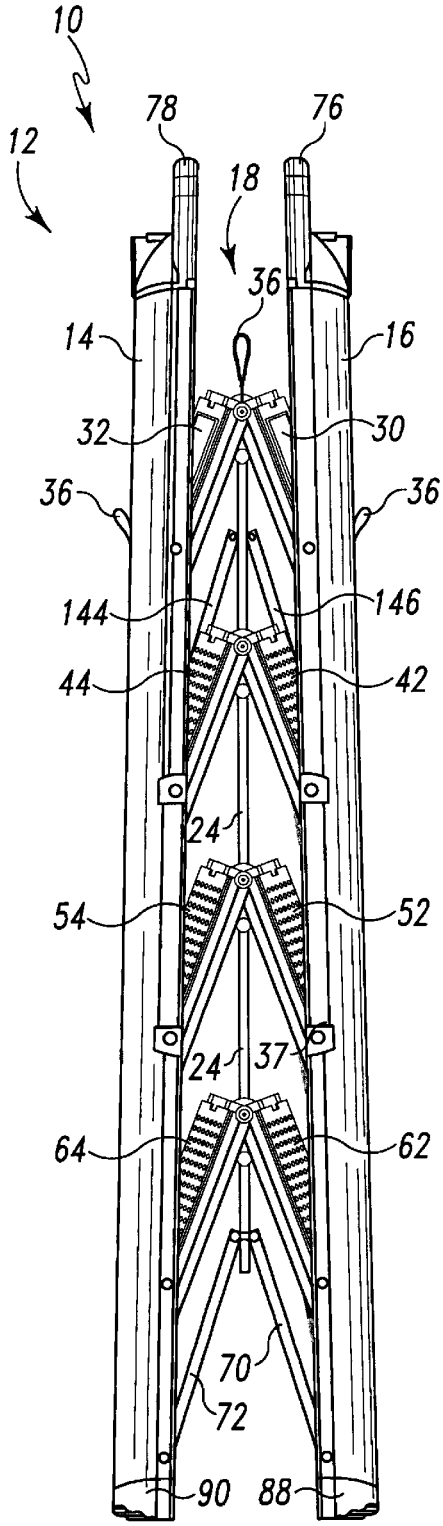
FIG. 10 is a front elevation view similar to FIG. 8, showing further movement of the ladder toward the closed position.
Figure 11A:
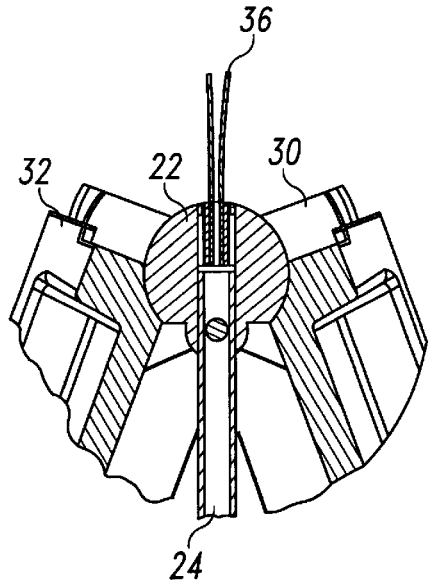
FIG. 11*a* is a sectional view, with portions broken away, similar to FIG. 9, of the anchor hinge associated with the guide taken along line 11*a*–11*a* of FIG. 3 showing movement of the slider hinge and the guide sections coupled thereto in an upward direction.
Figure 11B:
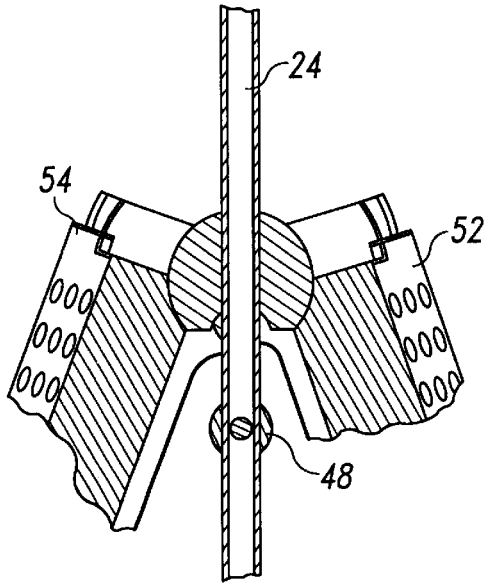
FIG. 11*b* is a sectional view, with portions broken away, similar to FIG. 9, of the slider hinge associated with a second of the steps taken along line 11*b*–11*b* of FIG. 3 showing movement of the slider hinge and the step sections coupled thereto in an upward direction away from the companion post coupled to the rod.
Figure 12:
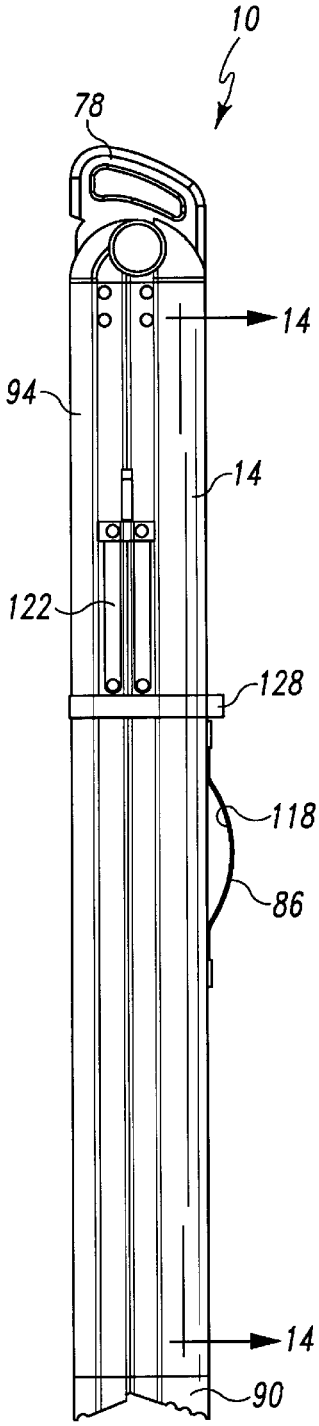
FIG. 12 is a side elevation view of the ladder in a closed position showing a left and a right grip handle forming a unified handle with a finger-receiving slot.
Figure 13:
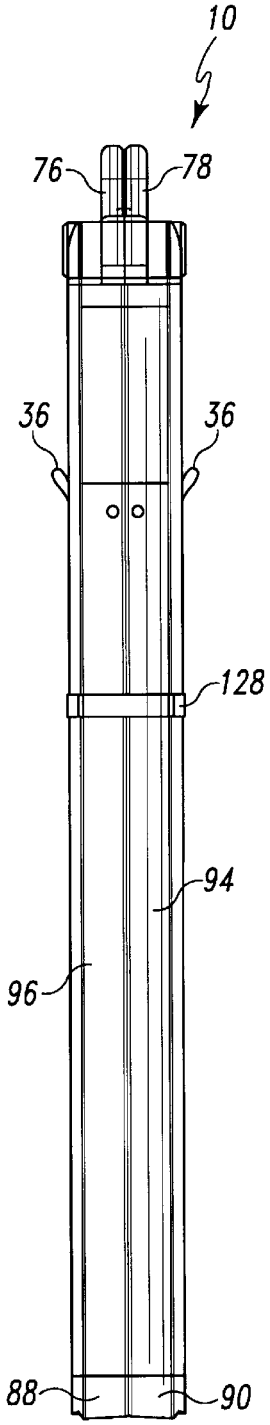
FIG. 13 is a rear elevation view of the ladder in the closed position similar to the FIG. 12.

To move ladder 10 from the opened position shown in FIGS. 1, 5, and 6, to the closed position, shown in FIG. 4, handle 36 is pulled upwardly so that rod 24 moves to a raised position in which guide sections 30, 32 begin movement from an end-to-end relation to one another to the closed position where sections 30, 32 pivot about guide pivot axis 34 to assume a side-by-side relation to one another and legs 14, 16 are arranged to lie in parallel relation to one another. As shown in FIGS. 3, 8, and 10, the upward movement of handle 36 causes anchor hinge 22 and rod 24 to move simultaneously in a generally in-line orientation.

As shown in FIGS. 3, 8, and 10, after handle 36 has been pulled upwardly, rod 24 moves from a lowered position associated with the opened position of legs 14, 16, to the raised position associated with the closed position of legs 14, 16. When rod 24 is moved to the raised position, first step sections 42, 44 begin pivoting movement about a step pivot axis 68 while slider hinge 46 moves upwardly along rod 24 away from first post 38. When leg 14 is in the closed position in parallel relation to leg 16, step sections 42, 44 are arranged to lie in side-by-side relation and contained within the generally U-shaped void formed in legs 14, 16. In the closed position, first post 38 is arranged to lie a first distance 148 below hinge 46. As shown best in FIG. 4, when ladder 10 is in the closed position, step sections 42, 44 are not visible.

Figure 14:
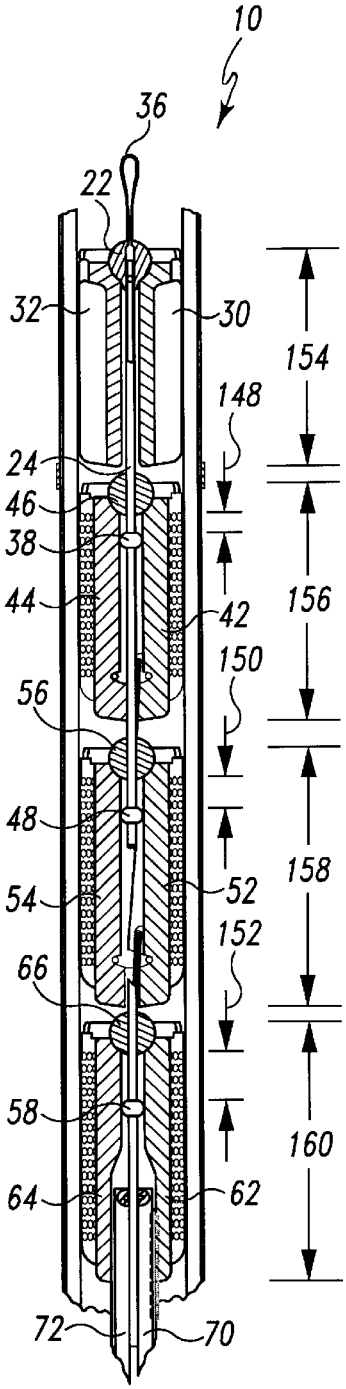
FIG. 14 is a sectional view, with portions broken away, taken along line 14—14 of FIG. 12, showing the step portions of three of the steps in a side-by-side relation with the ladder in the closed position.

Referring now to FIG. 14, as ladder 10 is folded to the closed position, second step sections 52, 54 move in a fashion similar to first step sections 42, 44. Since second step 50 is wider than first step 40, distance 158 of step sections 52, 54 is longer than distance 156 of step sections 42, 44 when the step sections are arranged in the side-by-side relation to one another associated with the closed position of ladder 10. Thus, second slider hinge 56 displaces a second distance 150 which is farther away from its associated post 48 than a distance 148 which first slider hinge 46 displaces away from its associated post 38. Likewise, third slider hinge 66 displaces a farther third distance 152 from its associated post 58 than the distance 150 which second slider hinge 56 displaces from its associated post 48 in the closed position of ladder 10.

As shown best in FIG. 14, the vertical distance between first slider hinge 46 and second slider hinge 56 when ladder 10 is in the closed position is not the same as the vertical distance when ladder 10 is in the opened position in order to accommodate the differences in step length. Thus, in the closed position, the distance between axis 68 of slider hinge 46 and axis 68 of slider hinge 56 is equal to the distance between hinges 46 and 56 in the opened position plus one half of the width of step 40 minus one half of the width of step 50. Likewise, in the closed position, the distance between axis 68 of hinge 56 and axis 68 of hinge 66 is equal to the distance between hinges 56 and 66 in the opened position plus one half of the width of step 50 minus one half of the width of step 60.

In the closed position shown in FIG. 4, a right grip handle 84 coupled to leg 16 and a left grip handle 86 coupled to leg 14 are arranged to lie in side-by-side relation to form a unified handle 116. Unified handle 116 is formed to include a finger-receiving slot 118 located between portions of handles 84, 86 and legs 14,16. Unified handle 116 provides a user with means for easily transporting the ladder 10 when it is in the closed position.

Auxiliary frame 82 includes a left leg 94, a right leg 96, a plurality of horizontal braces 130, 136, a brace mover 142, and a plurality of left and right diagonal braces 144, 146 arranged to lie between the left and right legs 94, 96. Brace mover 142 includes a rod 125 and a pull handle 36. Rod 125 is coupled to an anchor hinge 22 associated with first horizontal brace 130. Horizontal braces 130, 136 are configured in a bi-folding arrangement similar to guide 26 and step 60 of frame 12, and function in a similar manner when ladder 10 is moved from the opened position, as shown in FIG. 1, to the closed position shown in FIG. 4. Horizontal brace 136 is additionally coupled to legs 94 and 96 with springs 37. Springs 37 perform the same function with horizontal brace 136 as they do, for example, with step section 42.

As best shown in FIGS. 1–3, auxiliary frame 82 includes diagonal braces 144, 146 associated with the horizontal braces 130, 136. Diagonal braces 144, 146 function in the same manner and serve the same purpose as the diagonal braces 70, 72 associated with frame 12.

Although the disclosure has been described in detail with reference to certain preferred embodiments, variations, and modifications exist within the scope and spirit of the disclosure as described and as defined in the following claims.

What is claimed is:

1. A ladder comprising a frame including a left leg and a right leg, a plurality of steps arranged to lie between the left and right legs, each step including a left step section pivotably coupled to the left leg, a right step section pivotably coupled to the right leg, and a slider hinge pivotably coupled to each of the left and right step sections to support the left and right step sections for relative movement to one another about a step pivot axis between an aligned position wherein the left and right step sections are arranged to lie in end-to-end relation to one another upon movement of the left and right legs to an opened position in which the left leg is arranged to lie in non-parallel relation to the right leg and a folded position wherein the left and right step sections are arranged to lie in side-by-side relation to one another upon movement of the left and right legs to a closed position in which the left leg is arranged to lie in parallel relation to the right leg, and a step mover including a rod and a first post on the rod, wherein the rod is slidably coupled to at least one of the slider hinges for movement relative to the left and right legs between a lowered position associated with the opened position of left and right legs and a raised position associated with the closed position of the left and right legs and wherein the first post is arranged on the rod lie under and mate with a first of the slider hinges included in a first of the steps upon movement of the left and right legs to the opened position and to lie under and in spaced-apart relation to the first of the slider hinges upon movement of the left and right legs to the closed position.

2. The ladder of claim 1, wherein the step mover further includes a second post arranged on the rod to lie a predetermined distance below the first post, the second post is arranged to lie under and mate with a second of the slider hinges included in a second of the steps upon movement of the left and right legs to the opened position, the first post is arranged to lie a first distance below the first of the slider hinges upon movement of the left and right legs to the closed position, and the second post is arranged to lie a second distance, which second distance is greater than the first distance, below the second of the slider hinges upon movement of the left and right legs to the closed position.

3. The ladder of claim 2, wherein the step mover further includes a third post arranged on the rod to lie the predetermined distance below the second post, the third post is arranged to lie under and mate with a third of the slider hinges included in a third of the steps upon movement of the left and right legs to the opened position, and the third post is arranged to lie a third distance, which third distance is greater than the second distance, below the third of the slider hinges upon movement of the left and right legs to the closed position.

4. The ladder of claim 3, wherein the step mover further includes a rod support arranged to lie between the left and right legs and below the third of the steps, the rod support includes a left diagonal brace having a lower end pivotably coupled to the left leg, a right diagonal brace having a lower end pivotably coupled to the right leg, and a brace hinge pivotably coupled to an upper end of each of the left and right diagonal braces to support the left and right diagonal braces for relative movement to one another during movement of the left and right legs between the opened and closed positions, and the brace hinge is slidably coupled to a portion of the rod located below the third post to cause the third post to lie between the brace hinge and the third of the slider hinges.

5. The ladder of claim 1, wherein the step mover further includes a lower post arranged on the rod to lie below the first post and arranged to lie under and mate with another of the slider hinges included in another of the steps upon movement of the left and right legs to the opened position.

6. The ladder of claim 5, wherein the step mover further includes a rod support arranged to lie between the left and right legs, the rod support includes a left diagonal brace having a lower end pivotably coupled to the left leg, a right diagonal brace having a lower end pivotably coupled to the right leg, and a brace hinge pivotably coupled to an upper end of each of the left and right diagonal braces to support the left and right diagonal braces for movement relative to one another during movement of the left and right legs between the opened and closed positions, and the brace hinge is slidably coupled to a portion of the rod located below the lower post to cause the lower post to lie between the brace hinge and said another of the steps.

7. The ladder of claim 6, wherein the lower post contacts said another of the slider hinges and the brace hinge upon movement of the left and right legs to the opened position.

8. The ladder of claim 6, wherein the brace hinge includes a brace member formed to include a slot, a left fastener coupled to the brace member and to the left diagonal brace to establish a left pivot axis associated with the left diagonal brace, and a right fastener coupled to the brace member and to the right diagonal brace to establish a right pivot axis associated with the right diagonal brace and wherein the rod is arranged to extend through and slide in the slot formed in the brace member during movement of the left and right legs between the closed and opened positions.

9. The ladder of claim 6, wherein the left and right diagonal braces cooperate to define an obtuse included angle therebetween upon movement of the left and right legs to the opened position.

10. The ladder of claim 1, wherein the first of the slider hinges includes a slide member formed to include a slot and a fastener coupled to the slide member and each of the left and right step sections associated with the first of the slider hinges to establish the step pivot axis associated with the first of the slider hinges and wherein the rod is arranged to extend through and slide in the slot formed in the slide member during movement of the left and right legs between the closed and opened positions.

11. The ladder of claim 9, wherein the slide member of the first of the slider hinges is formed to include a concave edge defining a downwardly opening notch and the first post is configured to extend into the downwardly opening notch and contact the concave edge upon movement of the left and right legs to the opened position.

12. The ladder of claim 1, further comprising a left grip handle coupled to the left leg and a right grip handle coupled to the right leg and arranged to lie in side-by-side relation to the left grip handle upon movement of the left and right legs to the closed position to form a unified handle formed to include a finger-receiving slot located between portions of the left and right handle sections and portions of the left and right legs.

13. The ladder of claim 1, wherein the step mover further includes a left diagonal brace having a lower end pivotably coupled to the left leg, a right diagonal brace pivotably coupled to the right leg, and a brace hinge pivotably coupled to an upper end of each of the left and right diagonal braces to support the left and right diagonal braces for movement relative to one another during movement of the left and right legs between the opened and closed positions and wherein the brace hinge includes a brace member formed to include a slot, a left fastener coupled to the brace member and to the left diagonal brace to establish a left pivot axis associated with the left diagonal brace, and a right fastener coupled to the brace member and to the right diagonal brace to establish a right pivot axis associated with the right diagonal brace and wherein the rod is arranged to extend through and slide in the slot formed in the brace member during movement of the left and right legs between the closed and opened positions.

14. The ladder of claim 13, wherein the brace member is formed to include a concave edge defining an upwardly opening notch and the step member further includes a lower post arranged on the rod to lie below the first post and arranged to lie under and mate with another of the slider hinges included in another of the steps upon movement of the left and right legs to the opened position and wherein the lower post is configured to extend into the upwardly opening notch and contact the concave edge upon movement of the left and right legs to the opened position.

15. The ladder of claim 1, wherein the step mover further includes a guide arranged to lie between the left and right legs and above the first of the steps, the guide includes a left guide section pivotably coupled to the left leg, a right guide section pivotably coupled to the right leg, and an anchor hinge pivotably coupled to each of the left and right guide sections to support the left and right guide sections for relative movement to one another about a guide pivot axis between an aligned position wherein the left and right guide sections are arranged to lie in end-to-end relation to one another upon movement of the left and right legs to the opened position and a folded position wherein the left and right guide sections are arranged to lie in side-by-side relation to one another upon movement of the left and right legs to the closed position, and wherein the rod is coupled to the anchor hinge to move therewith relative to the left and right legs and wherein the step mover further includes a pull handle coupled to the anchor hinge and arranged to extend upwardly above the guide in a direction away from the first of the steps to provide means for moving the rod in an upward direction relative to the left and right legs to move each companion pair of left and right step sections to the folded position and the left and right legs to the closed position.

16. The ladder of claim 1, further comprising an auxiliary frame pivotably coupled to the left and right legs and a linkage coupled to the auxiliary frame and to the left and right legs to support the left and right legs in a predetermined inclined position upon movement of the left and right legs to the opened position relative to the auxiliary frame.

17. A ladder comprising a frame including a left leg and a right leg, a plurality of steps arranged to lie between the left and right legs, each step including a left step section pivotably coupled to the left leg, a right step section pivotably coupled to the right leg, and a slider hinge pivotably coupled to each of the left and right step sections to support the left and right step sections for relative movement to one another about a step pivot axis between an aligned position wherein the left and right step sections are arranged to lie in end-to-end relation to one another upon movement of the left and right legs to an opened position in which the left leg is arranged to lie in non-parallel relation to the right leg and a folded position wherein the left and right step sections are arranged to lie in side-by-side relation to one another upon movement of the left and right legs to a closed position in which the left leg is arranged to lie in parallel relation to the right leg, each slide hinge formed to include a slot, and a step mover including a rod arranged to extend through the slot formed in each slider hinge, a series of posts coupled to the rod and arranged to lie in equidistantly spaced-apart relation to one another along the length of the rod, and each post is lies under and mates with a companion one of the slider hinges upon movement of the left and right legs to the opened position and separates from the companion one of the slider hinges upon movement of the left and right legs to the closed position.

* * * * *